US006257356B1

(12) United States Patent
Wassell

(10) Patent No.: US 6,257,356 B1
(45) Date of Patent: Jul. 10, 2001

(54) MAGNETORHEOLOGICAL FLUID APPARATUS, ESPECIALLY ADAPTED FOR USE IN A STEERABLE DRILL STRING, AND A METHOD OF USING SAME

(75) Inventor: Mark Ellsworth Wassell, Kingswood, TX (US)

(73) Assignee: APS Technology, Inc., Cromwell, CT (US)

( * ) Notice: Subject to any disclaimer, the term of this patent is extended or adjusted under 35 U.S.C. 154(b) by 0 days.

(21) Appl. No.: 09/413,111

(22) Filed: Oct. 6, 1999

(51) Int. Cl.[7] ..... E21B 7/06

(52) U.S. Cl. ..... 175/61; 166/66.5; 166/66.6; 175/73

(58) Field of Search ..... 175/73, 61; 166/66.5, 166/66.6

(56) References Cited

U.S. PATENT DOCUMENTS

| | | | | |
|---|---|---|---|---|
| Re. 29,526 | * | 1/1978 | Jeter | 175/73 |
| 4,416,339 | | 11/1983 | Baker et al. | 175/61 |
| 4,637,479 | * | 1/1987 | Leising | 175/26 |
| 5,332,048 | | 7/1994 | Underwood et al. | 175/26 |
| 5,366,623 | * | 11/1994 | Clair | 210/222 |
| 5,382,373 | | 1/1995 | Carlson et al. | 252/62.55 |
| 5,398,917 | * | 3/1995 | Carlson et al. | 267/140.14 |
| 5,421,421 | | 6/1995 | Appleton | 175/76 |
| 5,454,943 | * | 10/1995 | Ashton et al. | 210/222 |
| 5,484,029 | | 1/1996 | Eddison | 175/73 |
| 5,529,133 | | 6/1996 | Eddison | 175/61 |
| 5,553,678 | | 9/1996 | Barr et al. | 175/73 |
| 5,617,926 | | 4/1997 | Eddison et al. | 175/61 |
| 5,638,910 | | 6/1997 | Noe et al. | 175/73 |
| 5,685,379 | | 11/1997 | Barr et al. | 175/61 |
| 5,695,015 | | 12/1997 | Barr et al. | 175/45 |
| 5,706,905 | | 1/1998 | Barr | 175/61 |
| 5,803,185 | | 9/1998 | Barr et al. | 175/45 |
| 5,842,149 | | 11/1998 | Harrell et al. | 702/6 |
| 6,019,201 | * | 2/2000 | Gordaminejad et al. | 188/267.1 |
| 6,116,354 | * | 9/2000 | Buytaert | 175/55 |
| 6,158,529 | * | 12/2000 | Dorel | 175/61 |

FOREIGN PATENT DOCUMENTS

| | | |
|---|---|---|
| 0 841 462 A2 | 11/1997 | (EP) . |
| WO 99/22383 | 5/1999 | (WO) . |

OTHER PUBLICATIONS

Carlson, J.D. et al., "Commercial Magneto–Rheological Fluid Devices," in *Suspensions and Associated Technology,* Bullough, W. (ed.), 1996, 8 pages.

Jolly, M.R. et al., "Properties and Applications of Commercial Magnetorheological Fluids," *SPIE 5th Annual Int. Symposium on Smart Structures and Materials,* San Diego, CA, Mar. 15, 1998, 14 pages.

"Magnetic Fluid Shocks," *Mech. Engineering,* 1999, 32–33.

* cited by examiner

*Primary Examiner*—Hoang Dang
(74) *Attorney, Agent, or Firm*—Woodcock Washburn Kurtz Mackiewicz & Norris LLP

(57) ABSTRACT

A rotatable steerable drill string in which guidance module controls the direction of the drilling. A magnetorheological fluid in the module supplies pressure to pistons that apply forces to the wall of the bore and thereby alter the direction of the drilling. The pressure applied by the magnetorheological fluid is regulated by valves that apply a magnetic field to the fluid so as to increase or decrease its fluid shear strength thereby controlling the actuation of the pistons and the direction of the drilling.

40 Claims, 9 Drawing Sheets

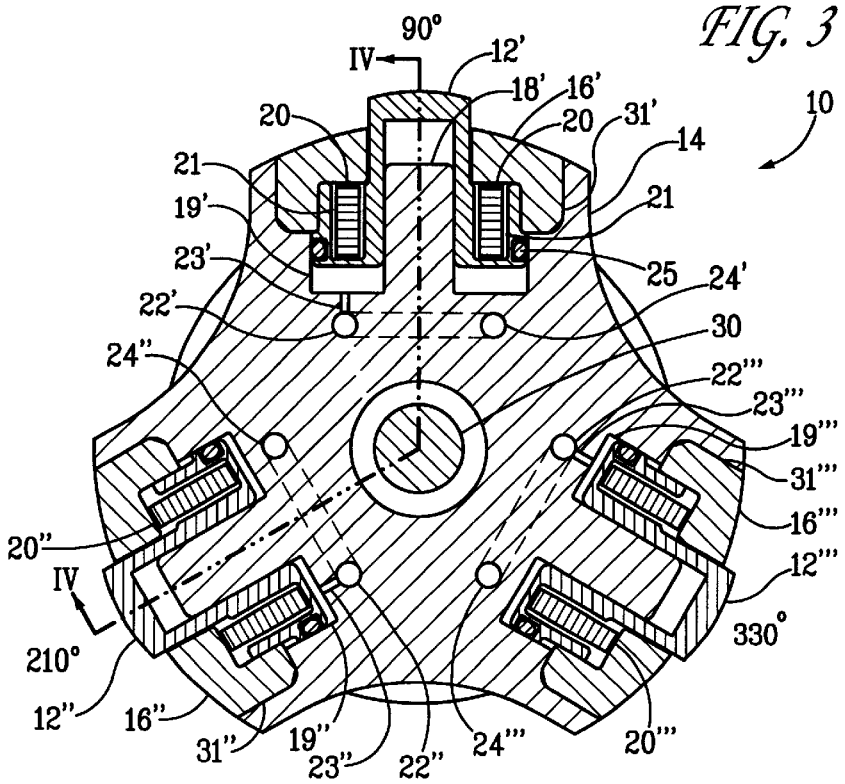
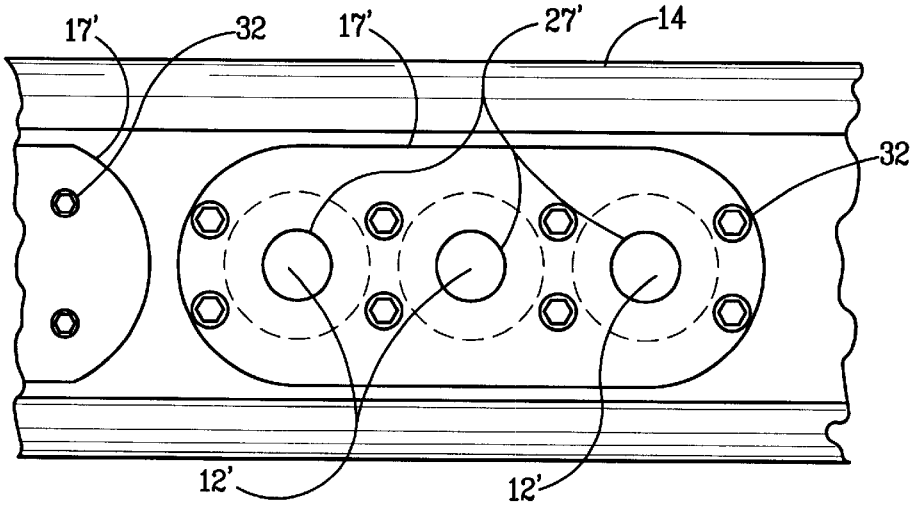
FIG. 5

MAGNETORHEOLOGICAL FLUID APPARATUS, ESPECIALLY ADAPTED FOR USE IN A STEERABLE DRILL STRING, AND A METHOD OF USING SAME

FIELD OF THE INVENTION

The current invention is directed to an apparatus and method for steering a device through a passage, such as the steering of a drill string during the course of drilling a well.

BACKGROUND OF THE INVENTION

In underground drilling, such as gas, oil or geothermal drilling, a bore is drilled through a formation deep in the earth. Such bores are formed by connecting a drill bit to sections of long pipe, referred to as a "drill pipe," so as to form an assembly commonly referred to as a "drill string" that extends from the surface to the bottom of the bore. The drill bit is rotated so that it advances into the earth, thereby forming the bore. In rotary drilling, the drill bit is rotated by rotating the drill string at the surface. In any event, in order to lubricate the drill bit and flush cuttings from its path, piston operated pumps on the surface pump a high pressure fluid, referred to as "drilling mud," through an internal passage in the drill string and out through the drill bit. The drilling mud then flows to the surface through the annular passage formed between the drill string and the surface of the bore.

The distal end of a drill string, which includes the drill bit, is referred to as the "bottom hole assembly." In "measurement while drilling" (MWD) applications, sensors (such as those sensing azimuth, inclination, and tool face) are incorporated in the bottom hole assembly to provide information concerning the direction of the drilling. In a steerable drill string, this information can be used to control the direction in which the drill bit advances.

Various approaches have been suggested for controlling the direction of the drill string as it forms the bore. The direction in which a rotating drill string is headed is dependent on the type of bit, speed of rotation, weight applied to the drill bit, configuration of the bottom hole assembly, and other factors. By varying one or several of these parameters a driller can steer a well to a target. With the wide spread acceptance of steerable systems in the 1980's a much higher level of control on the direction of the drill string was established. In the steerable system configuration a drilling motor with a bent flex coupling housing provided a natural bend angle to the drill string. The drill bit was rotated by the drilling motor but the drill string was not rotated. As long as the drill string was not rotated, the drill would tend to follow this natural bend angle. The exact hole direction was determined by a curvature calculation involving the bend angle and various touch points between the drill string and the hole. In this manner the bend angle could be oriented to any position and the curvature would be developed. If a straight hole was required both the drill string and the motor were operated which resulted in a straight but oversize hole.

There were several disadvantages to such non-rotating steerable drill strings. During those periods when the drill string is not rotating, the static coefficient of friction between the drill string and the borehole wall prevented steady application of weight to the drill bit. This resulted in a stick slip situation. In addition, the additional force required to push the non-rotating drill string forward caused reduced weight on the bit and drill string buckling problems. Also, the hole cleaned when the drill string is not rotating is not as good as that provided by a rotating drill string. And drilled holes tended to be tortuous.

Rotary steerable systems, where the drill bit can drill a controlled curved hole as the drill string is rotated, can overcome the disadvantages of conventional steerable systems since the drill string will slide easily through the hole and cuttings removal is facilitated.

Therefore it would also be desirable to provide a method and apparatus that permitted controlling the direction of a rotatable drill string.

SUMMARY OF THE INVENTION

It is an object of the current invention to provide a method and apparatus that permitted controlling the direction of a rotatable drill string. This and other objects is accomplished in a guidance apparatus for steering a rotatable drill string, comprising a guidance apparatus for steering a rotatable drill string through a bore hole, comprising (i) a housing for incorporation into the drill string, (ii) a movable member mounted in the housing so as to be capable of extending and retracting in the radial direction, the movable member having a distal end projecting from the housing adapted to engage the walls of the bore hole, (iii) a supply of a magnetorheological fluid, (iv) means for pressurizing the magnetorheological fluid, (v) means for supply the pressurized rheological fluid to the movable member, the pressure of the rheological fluid generating a force urging the movable member to extend radially outward, the magnitude of the force being proportional to the pressure of the rheological fluid supplied to the movable member, and (vi) a valve for regulating the pressure of the magnetorheological fluid supplied to the movable member so as to alter the force urging the movable member radially outward, the valve comprising means for subjecting the magnetorheological fluid to a magnetic field so as to change the shear strength thereof. In a preferred embodiment of the invention, the fluid is a magnetorheological fluid and the valve incorporates an electromagnetic for generating a magnetic field.

BRIEF DESCRIPTION OF THE DRAWINGS

FIG. 3 is a transverse cross-section through the guidance module shown in FIG. 1.

FIG. 5 is a view of one of the covers of the guidance module viewed from line V—V shown in FIG. 3.

DESCRIPTION OF THE PREFERRED EMBODIMENT

Figure 1:
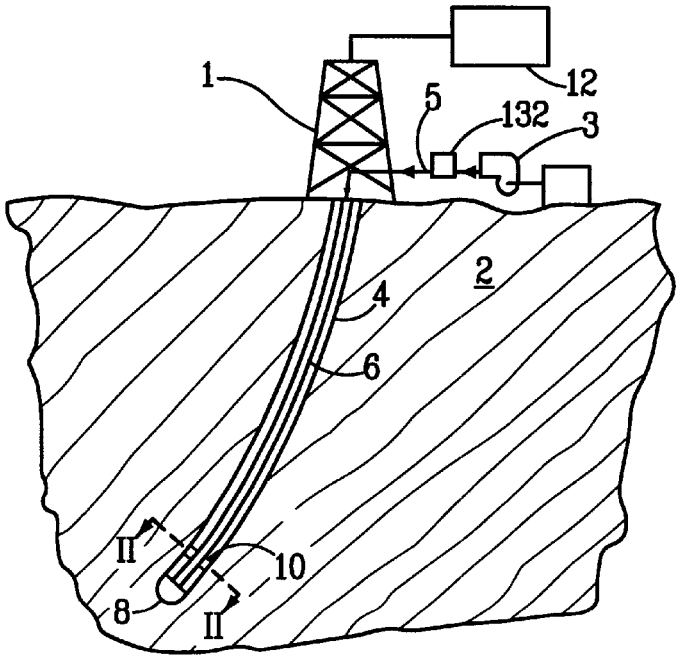
FIG. 1 is a schematic diagram of a drilling operation employing a steerable rotating drill string according to the current invention.

A drilling operation according to the current invention is shown in FIG. 1. A drill rig 1 rotates a drill string 6 that, as is conventional, is comprised of a number of interconnected sections. A drill bit 8, which preferably has side cutting ability as well as straight ahead cutting ability, at the extreme distal end of the drill string 6 advances into an earthen formation 2 so as to form a bore 4. Pumps 3 direct drilling mud 5 through the drill string 6 to the drill bit 8. The drilling mud 5 then returns to the surface through the annular passage 130 between the drill string 6 and the bore 4.

Figure 2:
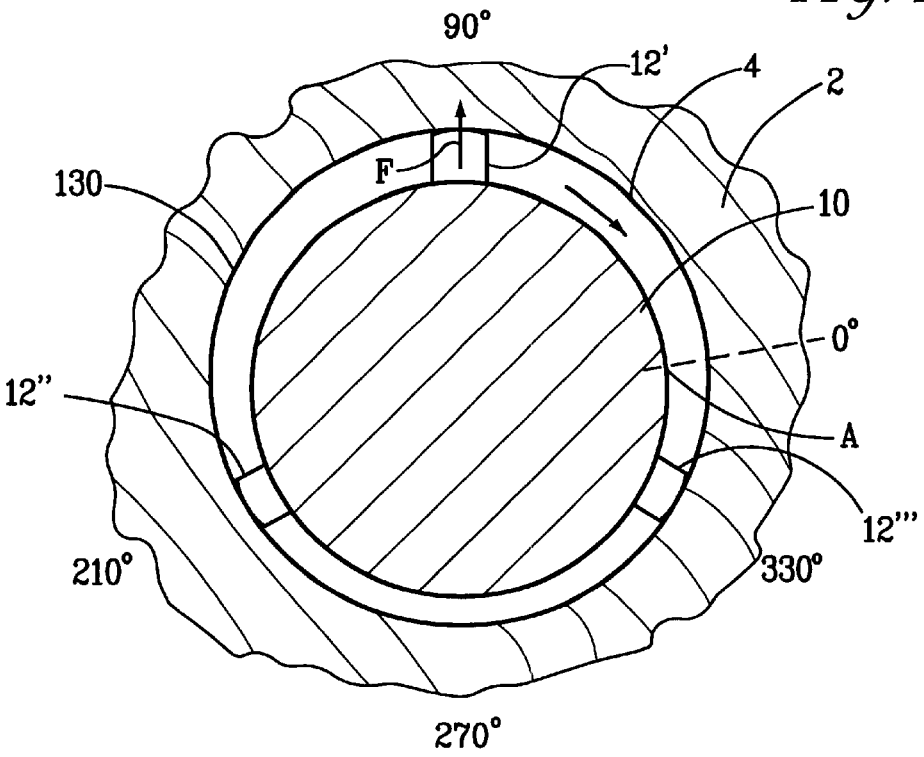
FIG. 2 is a cross-section taken through line II—II shown in FIG. 1 showing the steering of the drill string using a guidance module according to the current invention.
Figure 4:
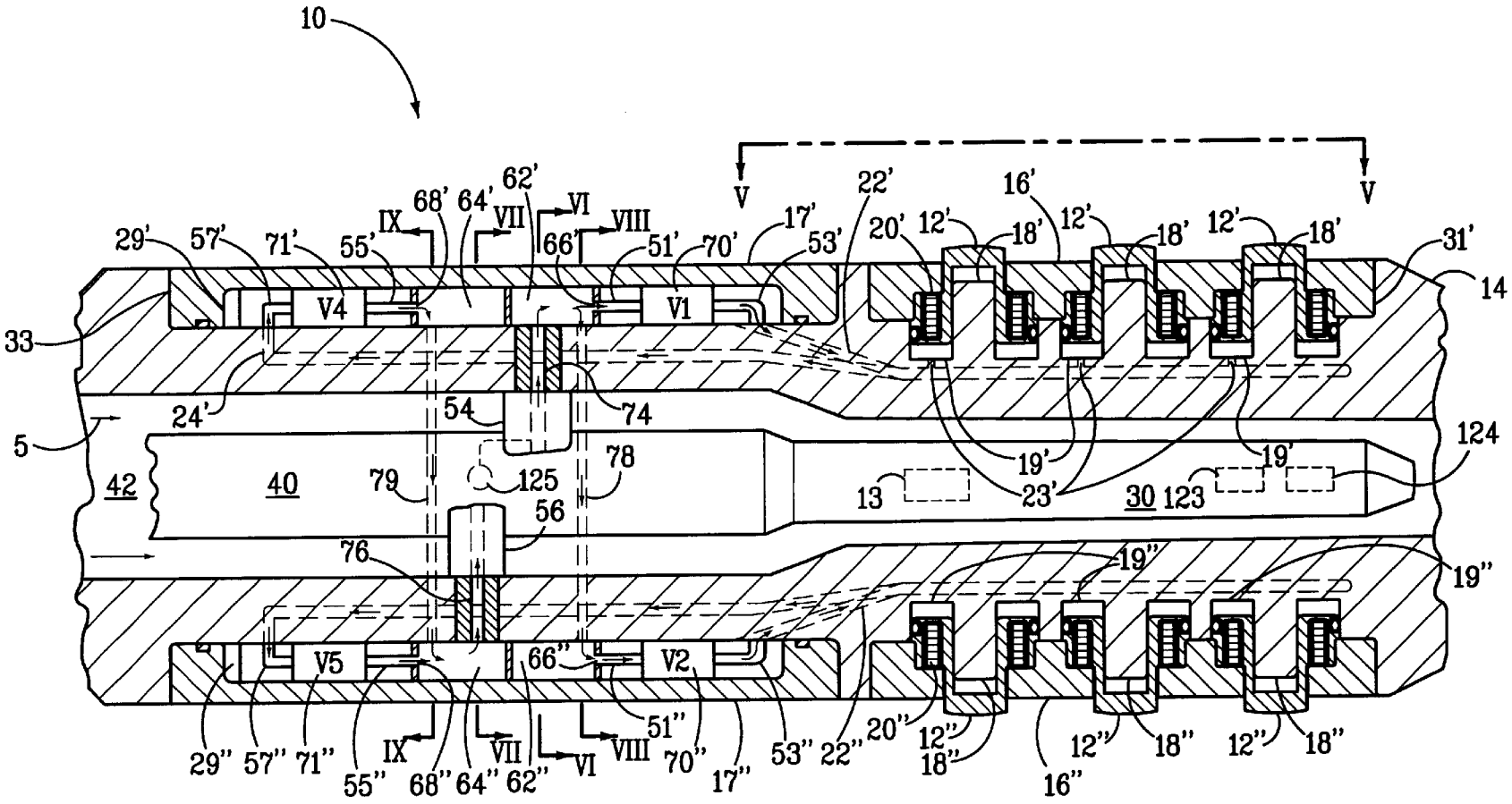
FIG. 4 is a longitudinal cross-section taken through line IV—IV shown in FIG. 3.

As shown in FIGS. 1 and 2, a guidance module 10 is incorporated into the drill string 6 proximate the drill bit 8 and serves to direct the direction of the drilling. As shown in FIGS. 3 and 4, in the preferred embodiment, the guidance module 10 has three banks of pistons 12 slidably mounted therein spaced at 120° intervals, with each bank of pistons comprising three pistons 12 arranged in an axially extending row. However, a lesser number of piston banks (including only one piston bank) or a greater number of piston banks (such as four piston banks) could also be utilized. In addition, a lesser number of pistons could be utilized in each of the banks (including only one piston per bank), as well as a greater number. Moreover, the piston banks need not be equally spaced around the circumference of the drill string.

Preferably, the pistons 12 are selectively extended and retracted during each rotation of the drill string so as to guide the direction of the drill bit 8. As shown in FIG. 2, the first bank of pistons 12', which are at the 90° location on the circumference of the bore 4, are extended, whereas the second and third banks of pistons 12" and 12''', which are at the 210° and 330° locations, respectively, are retracted. As a result, the first bank of pistons 12' exert a force F against the wall of the bore 4 that pushes the drill bit 8 in the opposite direction (i.e., 180° away in the 270° direction). This force changes the direction of the drilling. As shown in FIG. 1, the drill bit is advancing along a curved path toward the 90° direction. However, operation of the pistons 12 as shown in FIG. 2 will cause the drill bit to change its path toward the 270° direction.

Since the drill string 6 rotates at a relatively high speed, the pistons 12 must be extended and retracted in a precise sequence as the drill string rotates in order to allow the pistons to continue to push the drill string in the desired direction (e. g., in the 270° direction). For example, as shown in FIG. 2, after the pistons 12' in the first piston bank reach the 90° location, at which time they are fully extended, they must begin retracting so that they are fully retracted by the time the drill string rotates 120° so as to bring them to the 330° location. The pistons 12" in the second piston bank, however, must begin extending during this same time period so that they are fully extended when they reach the 90° location. The pistons 12''' in the third piston bank remain retracted as the drill string 6 rotates from the 330° location to the 210° location but then begin extending so that they too are fully extended when they reach the 90° location. Since the drill string 6 may rotate at rotational speeds as high as 250 RPM, the sequencing of the pistons 12 must be controlled very rapidly and precisely. According to the current invention, the actuation of the pistons 12 is controlled by magnetorheological valves, as discussed further below.

Alternatively, the guidance module 10 could be located more remotely from the drill bit so that operation of the pistons 12 deflects the drill pipe and adds curvature to the bottom hole assembly, thereby tilting the drill bit. When using this approach, which is sometimes referred to as a "three point system," the drill bit need not have side cutting ability.

A preferred embodiment of the guidance module 10 is shown in detail in FIGS. 3–13. As shown best in FIGS. 3 and 4, the guidance module 10 comprises a housing 14, which forms a section of drill pipe for the drill string, around which the three banks of pistons 12 are circumferentially spaced. Each bank of pistons 12 is located within one of three recesses 31 formed in the housing 14. Each piston 12 has a arcuate distal end for contacting the surface of the bore 4. However, in some applications, especially larger diameter drill strings, it may be desirable to couple the distal ends of the pistons together with a contact plate that bears against the walls of the bore 4 so that all of the pistons 12 in one bank are ganged together. Each piston 12 has a hollow center that allows it to slide on a cylindrical post 18 projecting radially outward from the center of a piston cylinder 19 formed in the bottom of its recess 31.

The radially outward movement of the pistons 12 in each piston bank is restrained by a cover 16 that is secured within the recess 31 by screws 32, shown in FIG. 5. Holes 27 in the cover 16 allows the distal ends of the pistons to project radially outward beyond the cover. In addition, in the preferred embodiment, four helical compression springs 20 are located in radially extending blind holes 21 spaced around the circumference of each piston 12. The springs 20 press against the cover 16 so as to bias the pistons 12 radially inward. Depending on the magnitude of the force urging the pistons 12 radially outward, which is applied by a magnetorheological fluid as discussed below, the pistons may be either fully extended, fully retracted, or at an intermediate position. Alternatively, the springs 20 could be dispensed with and the magnetorheological fluid relied upon exclusively to extend and retract the pistons 12.

Three valve manifold recesses 33 are also spaced at 120° intervals around the housing 14 so as to be axially aligned with the recesses 31 for the piston banks but located axially downstream from them. A cover 17, which is secured to the housing 14 by screws 32, encloses each of the valve manifold recesses 33. Each cover 17 forms a chamber 29 between it and the inner surface of its recess 33. As discussed below, each of the chambers 29 encloses valves and manifolds for one of the piston banks.

According to the current invention, the guidance module 10 contains a supply of a magnetorheological fluid. Magnetorheological fluids are typically comprised of non-colloidal suspensions of ferromagnetic or paramagnetic particles, typically greater than 0.1 micrometers in diameter.

The particles are suspended in a carrier fluid, such as mineral oil, water or silicone oil. Under normal conditions, magnetorheological fluids have flow characteristics of a convention oil. However, in the presence of a magnetic field, the particles become polarized so as to be organized into chains of particles within the fluid. The chains of particles act to increase the fluid shear strength or flow resistance of the fluid. When the magnetic field is removed, the particles return to an unorganized state and the fluid shear strength or flow resistance of the fluid returns to its previous value. Thus, the controlled application of a magnetic field allows the fluid shear strength or flow resistance of a magnetorheological fluid to be altered very rapidly. Magnetorheological fluids are described in U.S. Pat. No. 5,382,373 (Carlson et al. ), hereby incorporated by reference in its entirety. Suitable magnetorheological for use in the current invention are commercially available from Lord Corporation of Cary, N.C.

Figure 8:
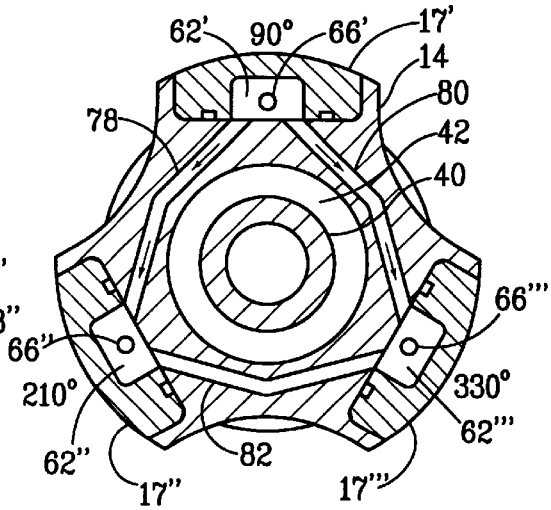
FIG. 8 is a transverse cross-section through the guidance module taken through line VIII—VIII shown in FIG. 3.
Figure 6A:
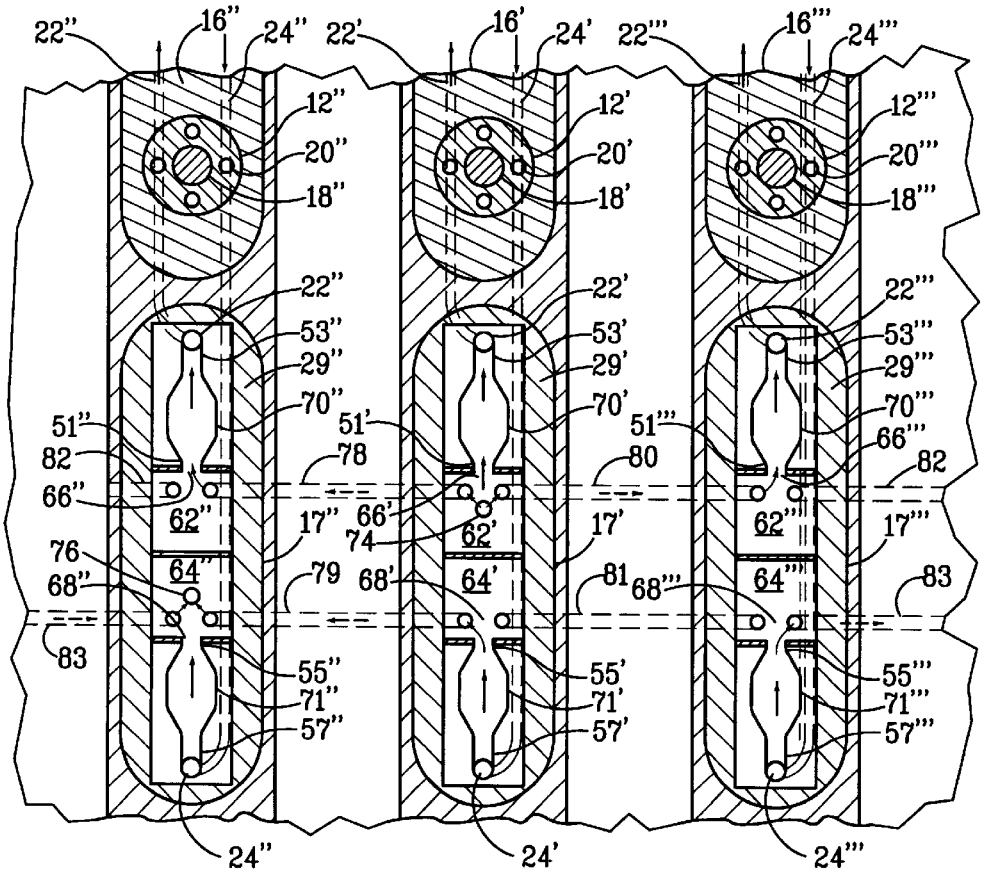
FIG. 6*a* is a cross-section taken through circular line VIa—VIa shown in FIG. 6 showing the arrangement of the valve and manifold section of the guidance module if it were split axially and laid flat.
Figure 10:
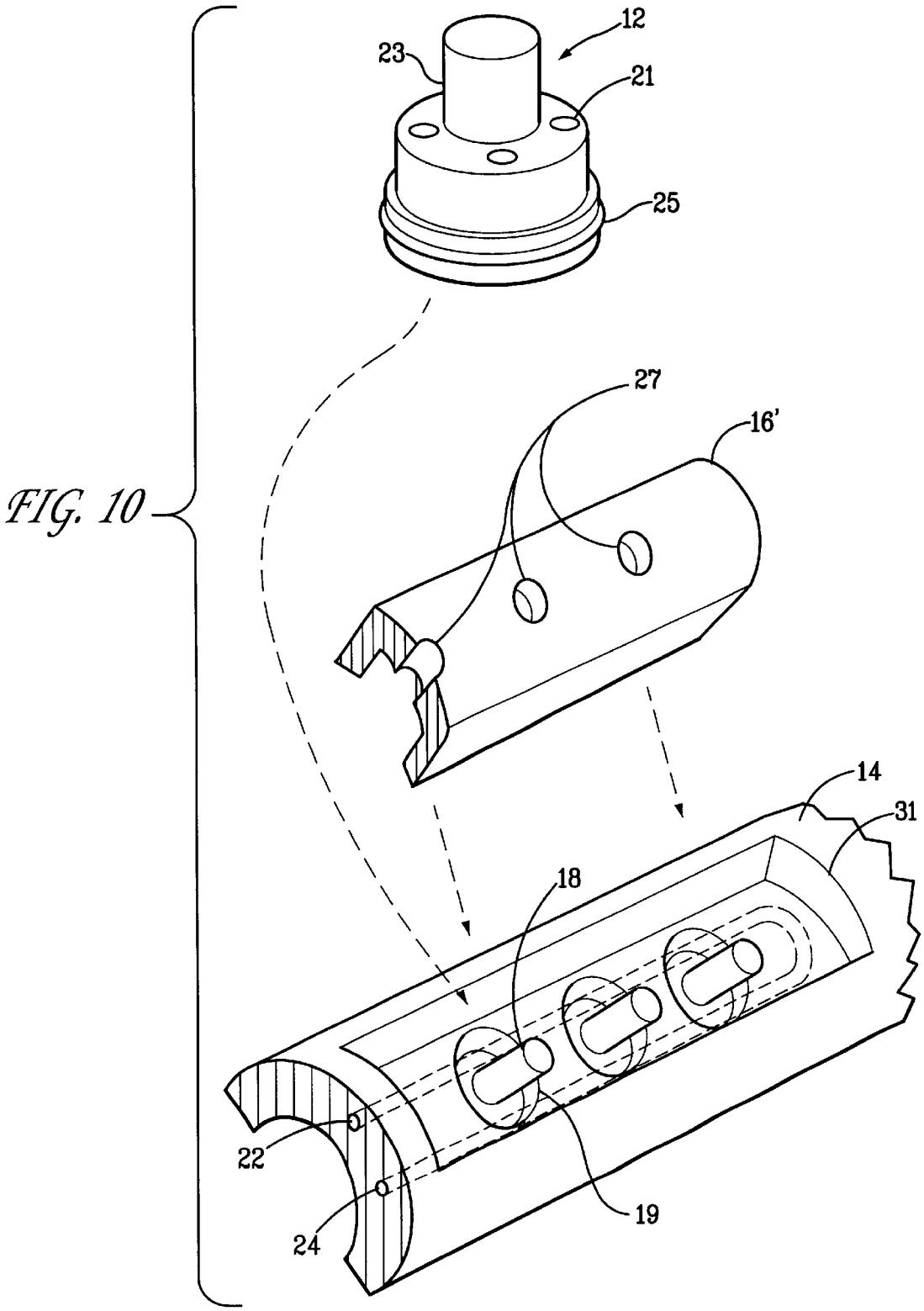
FIG. 10 is an exploded isometric view, partially in cross-section, of a portion of the guidance module shown in FIG. 3.

A central passage 42 is formed in the housing 14 through which the drilling mud 5 flows. A pump 40, which may be of the Moineau type, and a directional electronics module 30 are supported within the passage 42. As shown best in FIGS. 4 and 6, the pump 40 has an outlet 54 that directs the magnetorheological fluid outward through a radially extending passage 74 formed in the housing 14. From the passage 74, the magnetorheological fluid enters a supply manifold 62' formed in the chamber 29' that is axially aligned with the bank of pistons 12'. Two other supply manifolds 62" and 62'" are formed within the chambers 29" and 29"' so as to be axially aligned with the other two banks of pistons 12" and 12'", respectively. From the supply manifold 62', the magnetorheological fluid is divided into three streams. As shown in FIG. 4, the first stream flows through opening 66' into tubing 51' and then to a first supply valve 70'. As shown in FIGS. 4 and 8, the second stream flows through a circumferentially extending supply passage 78 formed in the housing 14 to the second supply manifold 62". As shown in FIGS. 4 and 6*a*, from the supply manifold 62" the second stream of magnetorheological fluid flows through opening 66" into tubing 51" and then to a second supply valve 70". Similarly, the third stream flows through circumferentially extending supply passage 80 to the third supply manifold 62'", then through opening 66'" into tubing 51'" and then to a third supply valve 70'". The supply valves 70 are discussed more fully below.

As shown in FIGS. 4 and 6*a*, sections of tubing 53 are connected to each of the three supply valves 70 and serve to direct the magnetorheological fluid from the supply valves to three axially extending supply passages 22 formed in the housing 14. Each supply passage 22 extends axially underneath one bank of pistons 12 and then turns 180° to form a return passage 24, as shown best in FIG. 10. As shown in FIGS. 3 and 4, radial passages 23 direct the magnetorheological fluid from the each of the supply passages 22 to the cylinders 19 in which the pistons 12 associated with the respective bank of pistons slide.

Figure 7:
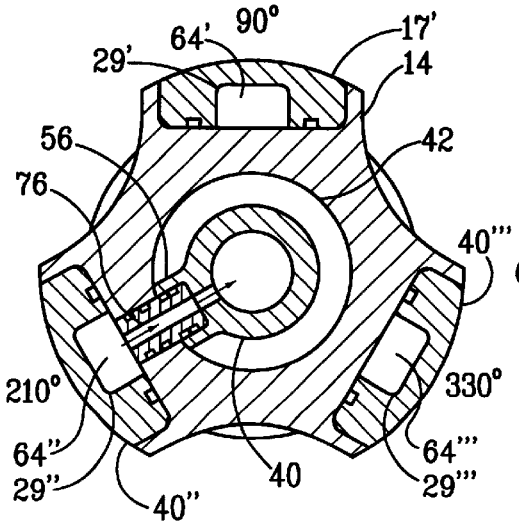
FIG. 7 is a transverse cross-section through the guidance module taken through line VII—VII shown in FIG. 3.
Figure 6:
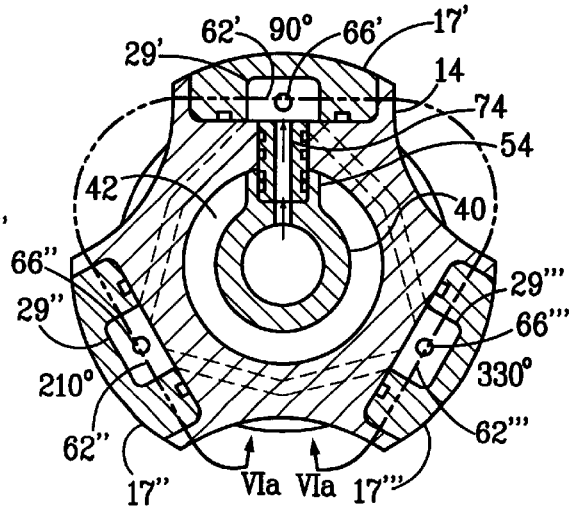
FIG. 6 is a transverse cross-section through the guidance module taken through line VI—VI shown in FIG. 3.
Figure 9:
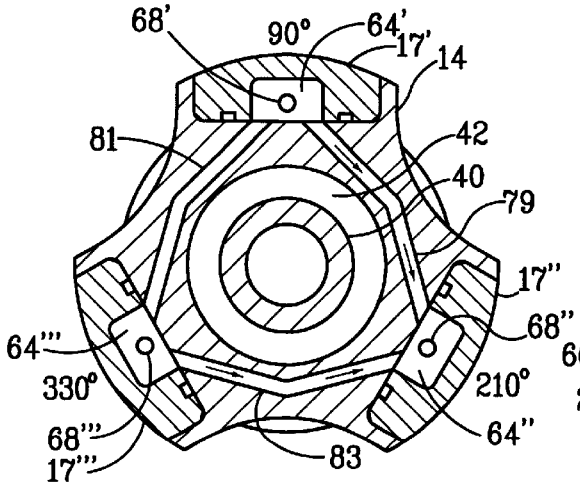
FIG. 9 is a transverse cross-section through the guidance module taken through line IX—IX shown in FIG. 3 (note that FIG. 9 is viewed in the opposite direction from the cross-sections shown in FIGS. 6–8).

As shown in FIGS. 4 and 6*a*, the return passage 24 for each bank of pistons 12 delivers the magnetorheological fluid to a section of tubing 57 disposed within the chamber 29 associated with that bank of pistons. The tubing 57 directs the fluid to three return valves 71, one for each bank of pistons 12. From the return valves 71, sections of tubing 55 direct the fluid to openings 68 and into three return manifolds 64. As shown in FIG. 9, passages 79 and 83 direct the fluid from the return manifolds 64' and 64'" to the return manifold 64" so that return manifold 64" receives the fluid from all three piston banks. As shown in FIG. 7, from the return manifold 64", the fluid is directed by passage 76 to the inlet 56 for the pump 40 where it is recirculated to the pistons 12 in a closed loop.

In operation, the pressure of the rheological fluid supplied to the cylinders 19 for each bank of pistons 12 determines the magnitude of the radially outward force that the pistons in that bank exert against the springs 20 that bias them radially inward. Thus, the greater the pressure supplied to the pistons 12, the further the pistons extend and the greater the radially outward force F that they apply to the walls of the bore 4. As discussed below, the pressure supplied to the pistons is controlled by the supply and return valves 70 and 71, respectively.

Figure 11:
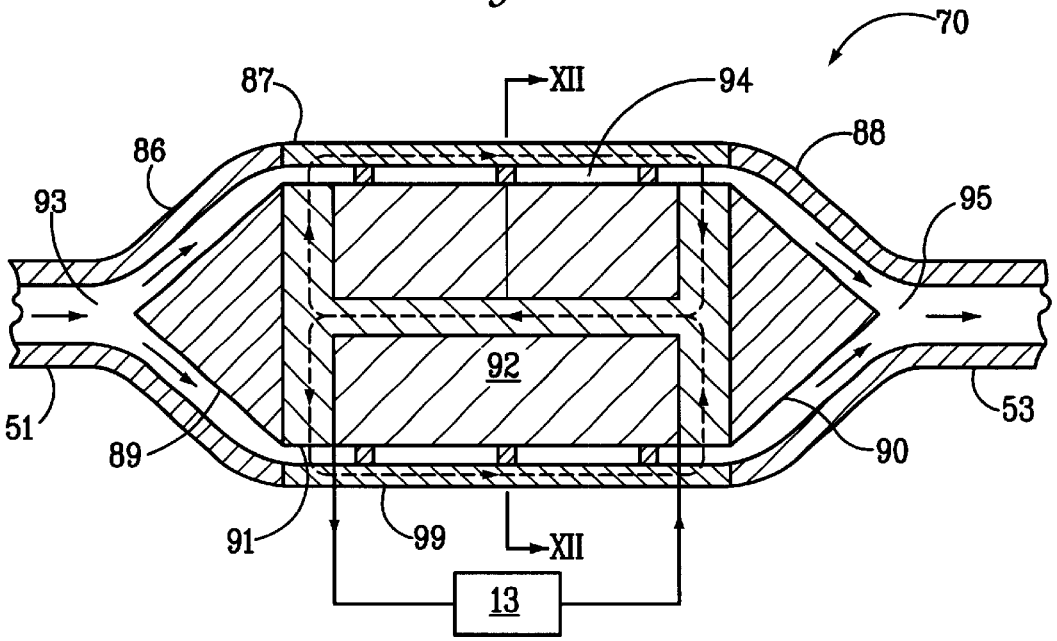
FIG. 11 is a longitudinal cross-section through one of the valves shown in FIG. 3.
Figure 12:
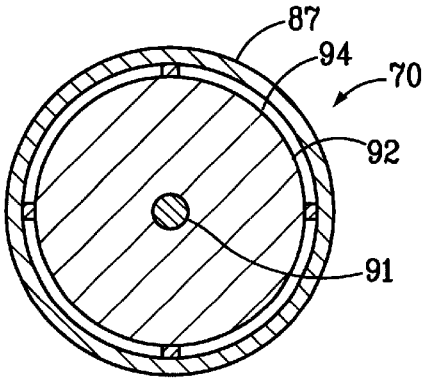
FIG. 12 is a transverse cross-section through a valve taken along line XII—XII shown in FIG. 11.

A supply valve 70 is shown in FIGS. 11 and 12. The valve 70 is electromagnetically operated and preferably has no moving parts. The valve 70 comprises an inlet 93 to which the supply tubing 51, which is non-magnetic, is attached. From the inlet 93, the rheological fluid flows over a non-magnetic end cap 89 enclosed by an expanded portion 86 of tubing 57. From the end cap 89, the rheological fluid flows into an annular passage 94 formed between a cylindrical valve housing 87, made from a magnetic material, and a cylindrical core 92. The core 92 is comprised of windings 99, such as copper wire, wrapped around a core body 91 that is made from a magnetic material so as to form an electromagnet. From the annular passage 94, the rheological fluid flows over a second end cap 90 enclosed within an expanded section 88 of the tubing 53, both of which are made from a non-magnetic material, and is discharged from the valve 20. Preferably, the magnetic material in the valve 70 is iron. A variety of materials may be used for the non-magnetic material, such as non-magnetic stainless steel, brass, aluminum or plastic. The return valves 71, which in some applications may be dispensed with, are constructed in a similar manner as the supply valves 70.

When electrical current flows through the windings 99, a magnetic field is developed around the core 92 that crosses the flow path in the passage 94 in two places at right angles. The strength of this magnetic field is dependent upon the amperage of the current supplied to the windings 99. As previously discussed, the shear strength, and therefore the flow resistance, of the magnetorheological fluid is dependent upon the strength of the magnetic field—the stronger the field, the greater the shear strength.

Figure 14:
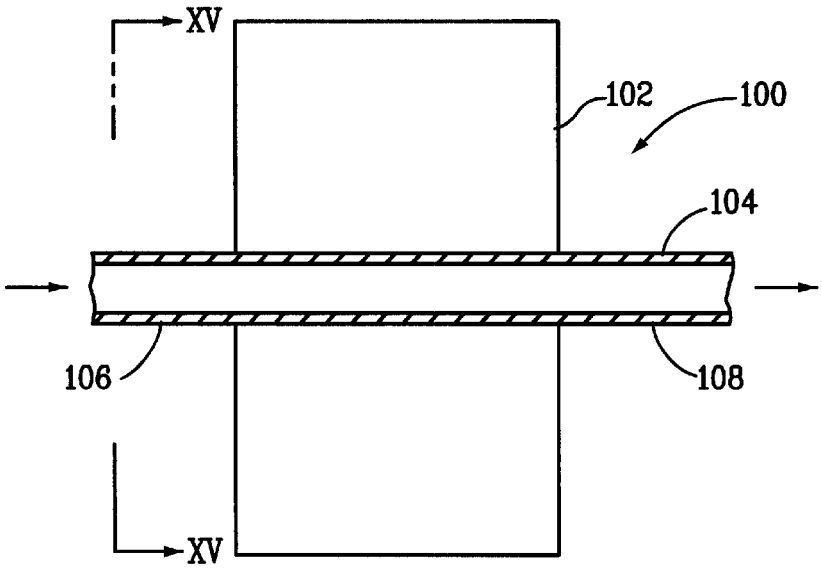
FIG. 14 is a longitudinal cross-section through an alternate embodiment of one of the valves shown in FIG. 3.
Figure 15:
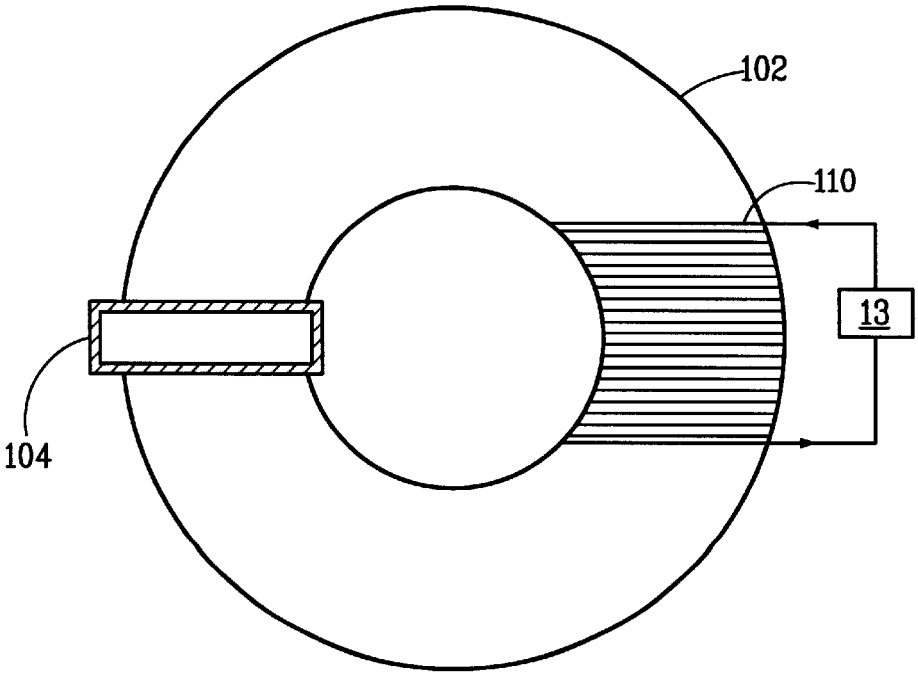
FIG. 15 is a transverse cross-section through a valve taken along line XV—XV shown in FIG. 14.

FIGS. 14 and 15 show an alternate embodiment of the supply and return valves 70 and 71. In this embodiment, the valve body consists of a rectangular channel 104 made from a magnetic material and having non-magnetic transition sections 106 and 108 at its inlet and outlet that mate with the tubing sections 51, 53, 55 and 57. The channel 104 is disposed within an electromagnet formed by a C-shaped section of magnetic material 102 around which copper windings 110 are formed.

Figure 16:
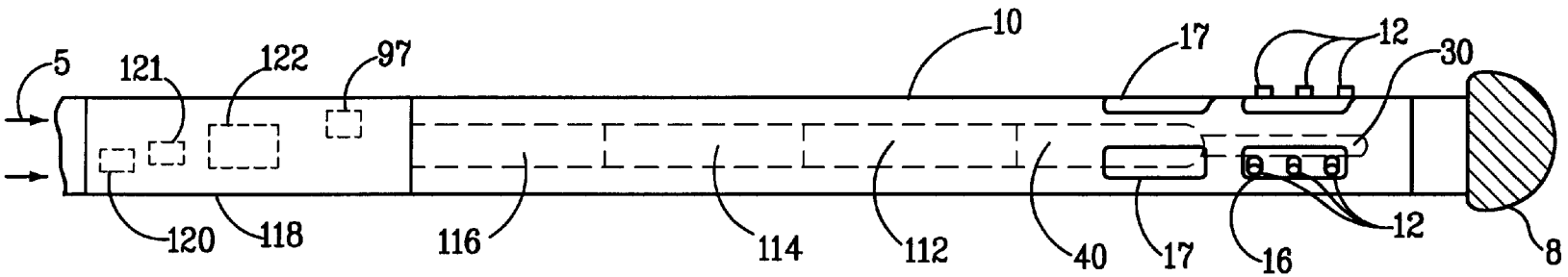
FIG. 16 shows a portion of the drill string shown in FIG. 1 in the vicinity of the guidance module.

FIG. 16 shows the portion of the drill string 6 in the vicinity of the guidance module 10. In addition to the pump 40 and directional electronics module 30, previously discussed, the guidance module 10 also includes a motor 116, which is driven by the flow of the drilling mud and which drives the pump 40, a bearing assembly 114, and an alternator 112 that provides electrical current for the module.

According to the current invention, actuation of the pistons 12 is controlled by adjusting a magnetic field within the valves 70 and 71. Specifically, the magnetic field is created by directing electrical current to flow through the windings 99. As previously discussed, this magnetic field increases the shear strength, and therefore the flow resistance, of the rheological fluid.

Figure 13:
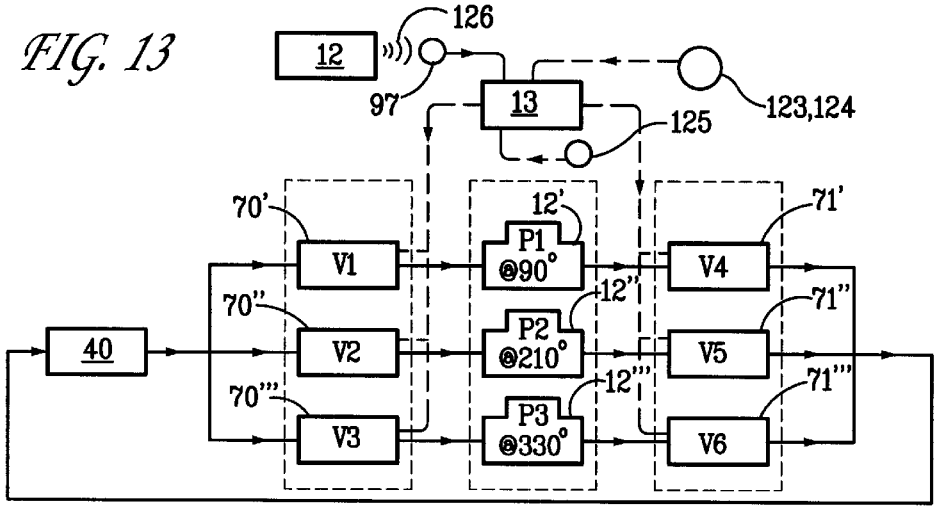
FIG. 13 is a schematic diagram of the guidance module control system.

As shown in FIGS. 11 and 13, the flow of electrical current to the windings 99 in each of the valves 70 and 71 is controlled by a controller 13, which preferably comprises a programmable microprocessor, solid state relays, and devices for regulating the amperage of the electrical current. Preferably, the controller 30 is located within the directional electronics module 30, although it could also be mounted in other locations, such as an MWD tool discussed below.

As shown in FIG. 4, the directional electronics module 30 may include a magnetometer 123 and an accelerometer 124 that, using techniques well known in the art, allow the determination of the angular orientation of a fixed reference point A on the circumference of the drill string 6 with respect to the circumference of the bore hole 4, typically north in a vertical well or the high side of the bore in a inclined well, typically referred to as "tool face". For example, as shown in FIG. 2, the reference point A on the drill string is located at the 0° location on the bore hole 4. The tool face information is transmitted to the controller 13 and allows it to determine the instantaneous angular orientation of each of the piston banks—that is, the first bank of pistons 12' is located at the 90° location on the bore hole 4, etc.

Preferably, the drill string 6 also includes an MWD tool 118, shown in FIG. 16. Preferably, the MWD tool 118 includes an accelerometer 120 to measure inclination and a magnetometer 121 to measure azimuth, thereby providing information on the direction in which the drill string is oriented. However, these components could also be incorporated into the directional electronics module 30. The MWD tool 118 also includes a mud pulser 122 that uses techniques well known in the art to send pressure pulses from the bottom hole assembly to the surface via the drilling mud that are representative of the drilling direction sensed by the directional sensors. As is also conventional, a strain gage based pressure transducer at the surface (not shown) senses the pressure pulses and transmits electrical signals to a data acquisition and analysis system portion of the surface control system 12 where the data encoded into the mud pulses is decoded and analyzed. Based on this information, as well as information about the formation 2 and the length of drill string 6 that has been extended into the bore 4, the drilling operator then determines whether the direction at which the drilling is proceeding should be altered and, if so, by what amount.

Preferably, the MWD tool 118 also includes a pressure pulsation sensor 97 that senses pressure pulsations in the drilling mud flowing in the annular passage 30 between the bore 4 and the drill string 6. A suitable pressure pulsation sensor is disclosed in U.S. patent application Ser. No. 09/086,418, filed May 29, 1999, entitled "Method And Apparatus For Communicating With Devices Downhole in a Well Especially Adapted For Use as a Bottom Hole Mud Flow Sensor," now U.S. Pat. No. 6,105,690, hereby incorporated by reference in its entirety. Based on input from the drilling operator, the surface control system 12 sends pressure pulses 126, indicated schematically in FIG. 13, downhole through the drilling mud 5 using a pressure pulsation device 132, shown in FIG. 1. The pulsations 126 are sensed by the pressure sensor 97 and contain information concerning the direction in which the drilling should proceed. The information from the pressure sensor 97 is directed to the guidance module controller 13, which decodes the pulses and determines, in conjunction with the signals from the orientation sensors 120 and 121 and the tool face sensors 123 and 124, the sequence in which the pistons 12 should be extended and, optionally, the amount of the change in the pressure of the rheological fluid supplied to the pistons 12.

The controller 13 then determines and sets the current supplied to the supply and return valves 70 and 71, respectively, thereby setting the strength of the magnetic field applied to the rheological fluid, which, in turn, regulates the pressure of the rheological fluid and the force that is applied to the pistons 12. For example, with reference to FIG. 2, if the surface control system 12 determined that the drilling angle should be adjusted toward the 270° direction on the bore hole 4 and transmitted such information to the controller 13, using mud flow telemetry as discussed above, the controller 13 would determine that the pistons in each piston bank should be extended when such pistons reached the 90° location.

According to the current invention, the force exerted by the pistons 12 is dependent upon the pressure of the rheological fluid in the piston cylinders 19, the greater the pressure, the greater the force urging the pistons radially outward. This pressure is regulated by the supply and return valves 70 and 71.

If it is desired to decrease the rheological fluid pressure in the cylinders 19 associated with a given bank of pistons 12, current is applied (or additional current is applied) to the windings of the valve 70 that supplies rheological fluid to that bank of pistons so as to create (or increase) the magnetic field to which the rheological fluid is subjected as it flows through the valve. As previously discussed, this magnetic field increases the fluid shear strength and flow resistance of the rheological fluid, thereby increasing the pressure drop across the valve 70 and reducing the pressure downstream of the valve, thereby reducing the pressure of the rheological fluid in the cylinders 19 supplied by that valve. In addition, the current to the windings in the return valve 71 associated with that bank of pistons is reduced, thereby decreasing the fluid shear strength and flow resistance of the return valve 71, which also aids in reducing pressure in the cylinders 19.

Correspondingly, if it is desired to increase the rheological fluid pressure in the cylinders 19 associated with a given bank of pistons 12, current is reduced (or cut off entirely) to the windings of the valve 70 that supplies rheological fluid to that bank of pistons so as to reduce (or eliminate) the magnetic field to which the rheological fluid is subjected as it flows through the valve. As previously discussed, this reduction in magnetic field decreases the fluid shear strength and flow resistance of the rheological fluid, thereby decreasing the pressure drop across the valve 70 and increasing the pressure downstream of the valve, thereby increasing the pressure of the rheological fluid in the cylinders 19 supplied by that valve. In addition, the current to the windings in the return valve 71 associated with that bank of pistons is increased, thereby increasing the fluid shear strength and flow resistance of the return valve 71, which also aids in increasing pressure in the cylinders 19. Since the pressure generated by the pump 40 may vary, for example, depending on the flow rate of the drilling mud, optionally, a pressure sensor 125 is incorporated to measure the pressure of the rheological fluid supplied by the pump and this information is supplied to the controller 13 so it can be taken into account in determining the amperage of the current to be supplied to the electromagnetic valves 70 and 71. In addition, the absolute pressure of the magnetorheological fluid necessary to actuate the pistons 12 will increase as the hole get deeper because the static pressure of the drilling mud in the annular passage 130 between the bore 4 and the drill string 6 increases as the hole get deeper and the column of drilling mud get higher. Therefore, a pressure compensation system can be incorporated into the flow path for the magnetorheological fluid to ensure that the pressure provided by the pump is additive to the pressure of the drilling mud surrounding the guidance module 10.

Thus, by regulating the current supplied to the windings of the supply and return valves 70 and 71, respectively, the controller 13 can extend and retract the pistons 12 and vary the force F applied by the pistons to the wall of the bore 4. Thus, the direction of the drilling can be controlled. Moreover, by regulating the current, the rate at which the drill bit changes direction (i.e., the sharpness of the turn), sometimes referred to as the "build rate," can also be controlled.

In some configurations, the drilling operator at the surface provides instructions, via mud flow telemetry as discussed above, to the controller 13 as to the amount of change in the electrical current to be supplied to the electromagnetic valves 70 and 71. However, in an alternative configuration, the drilling operator provides the direction in which the drilling should proceed. Using a feed back loop and the signal from the directional sensors 120 and 121, the controller 13 then varies the current as necessary until the desired direction is achieved.

Alternatively, the drilling operator could provide instructions, via mud flow telemetry, concerning the location to which the drill should proceed, as well as information concerning the length of drill string that has been extended into the bore 4 thus far. This information is then combined with information from the direction sensors 120 and 121 by the controller 13, which then determines the direction in which the drilling should proceed and the directional change necessary to attain that direction in order to reach the instructed location.

In all of the embodiments described above the transmission of information from the surface to the bottom hole assembly can be accomplished using the apparatus and methods disclosed in the aforementioned U.S. patent application Ser. No. 09/086,418, filed May 29, 1999, entitled "Method And Apparatus For Communicating With Devices Downhole in a Well Especially Adapted For Use as a Bottom Hole Mud Flow Sensor," now U.S. Pat. No. 6,105,690, previously incorporated by reference in its entirety.

In another alternative, the controller 13 can be preprogrammed to create a fixed drilling direction that is not altered during drilling.

Although the use of a magnetorheological fluid is preferred, the invention could also be practiced using electrorheological fluid. In such fluids the shear strength can be varied by using a valve to apply an electrical current through the fluid.

Although the invention has been described with reference to a drill string drilling a well, the invention is applicable to other situations in which it is desired to control the direction of travel of a device through a passage, such as the control of drilling completion and production devices. Accordingly, the present invention may be embodied in other specific forms without departing from the spirit or essential attributes thereof and, accordingly, reference should be made to the appended claims, rather than to the foregoing specification, as indicating the scope of the invention.

What is claimed:

1. A guidance apparatus for steering a rotatable drill string through a bore hole, comprising:

a) a housing for incorporation into said drill string;

b) a movable member mounted in said housing so as to be capable of extending and retracting in the radial direction, said movable member having a distal end projecting from said housing adapted to engage the walls of said bore hole;

c) a supply of a magnetorheological fluid;

d) means for pressurizing said magnetorheological fluid;

e) means for supplying said pressurized rheological fluid to said movable member, the pressure of said rheological fluid generating a force urging said movable member to extend radially outward, the magnitude of said force being proportional to the pressure of said rheological fluid supplied to said movable member; and f) a valve for regulating the pressure of said magnetorheological fluid supplied to said movable member so as to alter said force urging said movable member radially outward, said valve comprising means for subjecting said magnetorheological fluid to a magnetic field so as to change the shear strength thereof.

2. The guidance apparatus according to claim 1, wherein said movable member is a piston slidably mounted in said housing.

3. The guidance apparatus according to claim 1, wherein said means for supplying said pressurized fluid comprises a passage placing said pressurizing means in fluid flow communication with said movable member, and wherein said valve is disposed in said passage.

4. The guidance apparatus according to claim 1, further comprising:

g) a second movable member mounted in said housing so as to be capable of extending and retracting in the radial direction, said second movable member having a distal end projecting from said housing that is adapted to engage the walls of said bore hole, said second movable member being circumferentially spaced from said first movable member;

h) means for supplying said pressurized rheological fluid to said second movable member; and i) a second valve for regulating the pressure of said magnetorheological fluid supplied to said second movable member so as to alter said force urging said second movable member radially outward, said second valve comprising means for subjecting said magnetorheological fluid to a magnetic field so as to change the shear strength thereof.

5. The guidance apparatus according to claim 1, further comprising means for biasing said movable member radially inward.

6. The guidance apparatus according to claim 1, wherein said magnetorheological fluid comprises a suspension of magnetic particles.

7. The guidance apparatus according to claim 1, further comprising a controller for controlling a flow of electrical current to said valve, and wherein said valve comprises windings through which said electrical current flows for creating said magnetic field.

8. The guidance apparatus according to claim 1, wherein said means for supplying said pressurized fluid comprises a passage placing said pressurizing means in fluid flow communication with said movable member, and wherein said valve is a first valve, said first valve disposed in said passage upstream of said movable member, and further comprising a second valve for regulating the pressure of said magnetorheological fluid supplied to said movable member so as to also alter said force urging said movable member radially outward, said second valve comprising means for subjecting said magnetorheological fluid to a magnetic field so as to change the shear strength thereof, said second valve disposed in said passage downstream of said movable member.

9. The guidance apparatus according to claim 1, further comprising:

g) means for receiving a steering instruction from a location proximate the surface of the earth; and h) a controller for generating a flow of electrical current for operating said valve in response to said steering instruction received.

10. The guidance apparatus according to claim 9, wherein said steering instruction comprises a direction to which said rotatable drill string is to be steered.

11. The guidance apparatus according to claim 9, wherein said steering instruction comprises an instruction representative of the amplitude of said flow of electrical current.

12. The guidance apparatus according to claim 9, wherein said steering instruction receiving means comprises a pressure pulsation sensor.

13. The guidance apparatus according to claim 1, further comprising means for determining the angular orientation of said movable member.

14. The guidance apparatus according to claim 1, wherein said movable member is first movable member, and further comprising a second movable member mounted in said housing so as to be capable of extending and retracting in the radial direction, said second movable member having a distal end projecting from said housing adapted to engage the walls of said bore hole and being circumferentially displaced from said first movable member.

15. A guidance apparatus for steering a drill string drilling a bore hole having a wall, comprising:

a) a housing for incorporation into said drill string;

b) a pressurized magnetorheological fluid disposed within said housing;

c) a movable member mounted in said housing so as to be capable of movement in response to said pressure of said magnetorheological fluid, said movable member having a distal end projecting from said housing adapted to engage said wall of said bore hole;

d) an electromagnet located so as to create a magnetic field that alters the shear strength of at least a portion of said magnetorheological fluid; and e) a controller for controlling the flow of electrical current to said electromagnet so as to control said pressure of at least said portion of said rheological fluid.

16. The guidance apparatus according to claim 15, wherein said movable member is a first movable member and said electromagnet is a first electromagnet, and further comprising:

f) a second movable member mounted in said housing so as to be capable of movement in response to said pressure of said magnetorheological fluid, said second movable member having a distal end projecting from said housing adapted to engage said wall of said bore hole and being circumferentially displaced from said first movable member;

g) a second electromagnet located so as to create a second magnetic field that alters the shear strength of a second portion of said magnetorheological fluid.

17. The guidance apparatus according to claim 15, further comprising means for receiving a steering instruction from a location proximate the surface of the earth, and wherein said controller controls the flow of electrical current to said electromagnet in response to said steering instructions received.

18. The guidance apparatus according to claim 17, wherein said steering instruction comprises a direction to which said drill string is to be steered.

19. The guidance apparatus according to claim 15, wherein said steering instruction comprises an instruction representative of the amplitude of said flow of electrical current to said electromagnet.

20. The guidance apparatus according to claim 15, wherein said bore hole is filled with drilling fluid, and further comprising a pressure transducer for sensing pressure pulsations in said drilling fluid that contain information representative of a steering instruction.

21. A guidance apparatus for steering a drill string while drilling a bore hole having a wall, comprising:

a) means for applying a force to said wall of said bore hole in response to pressure from a magnetorheological fluid so as to direct the path of said drill string;

b) an electromagnet located so as to create a magnetic field that alters the shear strength of at least a portion of said magnetorheological fluid; and c) a controller for controlling a flow of electrical current to said electromagnet so as to control the strength of said magnetic field to which at least said portion of said rheological fluid is subjected.

22. The apparatus according to claim 21, further comprising means for receiving a steering instruction from a location proximate the surface of the earth, and wherein said controller controls the flow of electrical current to said electromagnet in response to said steering instructions received.

23. The guidance apparatus according to claim 22, wherein said steering instruction comprises a direction to which said device is to be steered.

24. The guidance apparatus according to claim 22, wherein said steering instruction comprises an instruction representative of the amplitude of said flow of electrical current to said electromagnet.

25. The guidance apparatus according to claim 21, wherein said bore hole is filled with drilling fluid, and further comprising a pressure transducer for sensing pressure pulsations in said drilling fluid that contain information representative of a steering instruction.

26. An apparatus for use down hole in a well, comprising:

a) a housing;

b) a magnetorheological fluid disposed within said housing;

c) an electromagnet located so as to create a magnetic field that alters the shear strength of at least a portion of said magnetorheological fluid; and d) a controller for controlling a flow of electrical current to said electromagnet so as to control the strength of said magnetic field to which said portion of said rheological fluid is subjected.

27. The apparatus according to claim 26, further comprising means for receiving information from a location proximate the surface of the earth for controlling said flow of electrical current to said electromagnet.

28. The guidance apparatus according to claim 26, wherein said well is filled with a fluid, and further comprising a pressure transducer for sensing pressure pulsations in said well fluid that contain information for controlling said flow of electrical current to said electromagnet.

29. A method of steering a drill string drilling a bore hole, said drill string having a guidance apparatus comprising at least one movable member mounted therein so that movement of said movable member alters the path of said drilling, comprising the steps of:

a) supplying a magnetorheological fluid to said movable member;

b) creating a magnetic field to which said magnetorheological fluid is subjected that affects the pressure of said magnetorheological fluid supplied to said movable member, thereby causing said movable member to move so as to alter the path of said drill string.

30. The steering method according to claim 29, further comprising the step of varying the strength of said magnetic field so as to vary the pressure of said magnetorheological fluid supplied to said movable member, thereby further altering the direction of the path of said drill string.

31. The steering method according to claim 29, further comprising the step of transmitting a steering instruction to said guidance device from a location proximate the surface of the earth.

32. The steering method according to claim 31, wherein said bore hole is filled with drilling fluid, and wherein said step of transmitting said steering instruction comprising transmitting information representative of a steering instruction through said drilling fluid.

33. The steering method according to claim 32, wherein the step of transmitting said information through said drilling fluid comprises transmitting pressure pulsations through said drilling fluid to a pressure transducer.

34. The steering method according to claim 29, wherein movement of said movable member causes said movable member to apply a force to said bore hole that alters the path of said drill string.

35. A method of steering a drill string drilling a bore hole having a wall, said drill string having a guidance apparatus comprising a plurality of movable members mounted therein each of which is adapted to apply a force to said bore hole wall that alters the path of said drill string, comprising the steps of:

a) supplying magnetorheological fluid to each of said movable members;

b) subjecting said magnetorheological fluid supplied to at least a selected one of said movable members to a magnetic field.

36. The steering method according to claim 35, further comprising the step of selectively varying the strength of a magnetic field to which said magnetorheological fluid supplied to each of said movable members is subjected so as to vary the force applied by said movable members to said bore hole wall.

37. The steering method according to claim 35, further comprising the step of transmitting a steering instruction to said guidance device from a location proximate the surface of the earth.

38. The steering method according to claim 37, wherein said bore hole is filled with drilling fluid, and wherein said step of transmitting said steering instruction comprising transmitting information representative of a steering instruction through said drilling fluid.

39. The steering method according to claim 38, wherein the step of transmitting said information through said drilling fluid comprises transmitting pressure pulsations through said drilling fluid to a pressure transducer.

40. A method for operating an apparatus down in a well, comprising the steps of:

a) flowing a magnetorheological fluid through at least a portion of said apparatus;

b) subjecting at least a portion of said magnetorheological fluid to a magnetic field so as to alter the shear strength thereof.

* * * * *